United States Patent [19]

Eisenberg

[11] 4,405,116

[45] Sep. 20, 1983

[54] ADJUSTABLE PEDESTAL TRESTLE FOR THEATER STAGES OR THE LIKE

[76] Inventor: Hans-Jochen Eisenberg, Triebelsheide 59, 5600 Wuppertal 1, Fed. Rep. of Germany

[21] Appl. No.: 230,806

[22] Filed: Feb. 2, 1981

[30] Foreign Application Priority Data

Jan. 31, 1980 [DE] Fed. Rep. of Germany ..... 3003392

[51] Int. Cl.[3] ..... B66F 3/22

[52] U.S. Cl. ..... 254/122; 182/141; 187/18

[58] Field of Search ..... 254/122, 124, 126, 9 R, 254/9 B, 9 C; 187/18, 8.5, 8.71, 8.72; 182/63, 69, 141

[56] References Cited

U.S. PATENT DOCUMENTS

| | | | |
|---|---|---|---|
| 530,120 | 12/1894 | Oakley | 182/141 |
| 2,554,494 | 5/1951 | Hodgin | 254/122 |
| 2,931,519 | 4/1960 | Beach | 254/9 R |
| 3,464,519 | 9/1969 | Whisler | 182/141 |
| 3,640,502 | 2/1972 | Bargman | 254/89 R |
| 3,823,915 | 7/1974 | Koehler | 254/122 |

FOREIGN PATENT DOCUMENTS

| | | | |
|---|---|---|---|
| 856647 | 11/1970 | Canada | 254/122 |
| 641486 | 2/1937 | Fed. Rep. of Germany . | |
| 1211725 | 4/1902 | France . | |
| 1459313 | 11/1966 | France . | |

*Primary Examiner*—Robert C. Watson

*Attorney, Agent, or Firm*—Antonelli, Terry & Wands

[57] ABSTRACT

A vertically adjustable pedestal trestle for theater stages or the like which includes a platform carried by a top frame and lockable supporting scissors are articulated to corners of the top frame as well as a vertical adjustment device which may be driven by motor power or manually. The vertical adjustment device includes one or more additional lifting scissors arranged centrally below the platform. The lifting scissors are provided at respective leg ends with runners or sliding elements and are adapted to be extended toward the underside of the platform.

18 Claims, 7 Drawing Figures

ADJUSTABLE PEDESTAL TRESTLE FOR THEATER STAGES OR THE LIKE

The present invention relates to a pedestal construction and, more particularly, to a vertically adjustable pedestal trestle for theater stages or the like, which includes a platform carried by a top frame and lockable supporting scissors articulated to the corners of the top frame, and a vertical adjustment device which is adapted to be driven by a drive motor or by body strength.

In German Utility Model No. 7,332,414, a pedestal trestle of the aforementioned type is proposed which may be adjusted in a vertical direction in an infinitely variable fashion, wherein upper displaceable legs of the supporting scissors are articulated to spindle nuts and guided in the top frame construction and secured against turning. The spindle nuts are displaceable by means of two parallel threaded spindles. A pitch of the thread of the threaded spindles is such that in this proposed arrangement a self locking action is provided by means of which the pedestal trestle is stopped or arrested at the respectively set heights.

With a pedestal trestle of the aforementioned type, especially with a motor driven spindle operation, theoretically a vertical adjustment may be executed by only one person. However, for this purpose, all movable parts must be manufactured with great precision and all rods and struts must be produced with high torsional resistance in order to exclude any canting or jamming which could result even in bending deformations of the linkage. Therefore, a disadvantage of this proposed construction resides in the fact that its construction requires a high technical expenditure so that the resulting pedestal trestle becomes relatively expensive and, in general, is of such heavy weight that it can only be transported with great effort during a reconstruction of the stage.

A further disadvantage of the aforementioned proposed pedestal trestle resides in the fact that such trestle requires, even in a folded condition, a considerable spreading of its supporting scissors so that it can still be raised by operating the spindle drive. Consequently, the resulting individual pedestal trestle occupies a considerable amount of space in a vertical direction even when stacked.

The aim underlying the present invention essentially resides in providing a pedestal trestle which is vertically adjustable by way of a drive mechanism, wherein a vertical adjustment may be readily performed while the overall stacking height of the pedestal trestle is relatively small.

In accordance with advantageous features of the present invention, the vertical adjustment device includes one or two additional lifting scissors arranged centrally below the platform of the pedestal trestle, with the scissors being provided at respective ends thereof with runners rollers, or sliding elements, and with the scissors being extensible toward an underside of the platform.

An advantage of a pedestal trestle constructed in accordance with the present invention which utilizes one or two separate lifting scissors in addition to the normally provided supporting scissors arranged at the corners of the platform, the supporting scissors may be moved downwardly up to a flat dead center location in the lowest position wherein the resting or stacking height of the pedestal trestle depends only upon a thickness of the platform necessary for reasons of stability and on the cross sectional dimensions of the top frame and supporting scissors legs.

When the pedestal trestle of the present invention is folded down to a minimum, a cavity still remains beneath the platform between the folded together legs of the supporting scissors, which cavity may be used to accommodate the lifting scissor legs which are constructed of an adequate rigidity or ruggedness with a certain minimum spreading expansion. The legs of the lifting scissors may be displaced out of the cavity so as to assume an erect position by an appropriate drive mechanism.

Advantageously, in accordance with further features of the present invention, the supporting scissors, unlocked during a vertical adjustment, run along only loosely so that, in this arrangement, such a great play may be provided that no canting or jamming whatever may occur anymore due to the supporting scissors. During a vertical adjustment, the lifting scissors are merely required to lift the weight of the platform and, in part, the weight of the supporting scissors. Thus, the lifting scissors may be constructed so as to have a relatively thin cross section. Therefore, after a vertical adjustment, the legs of the supporting scissors are again locked at the pedestal trestle and these supporting legs, in turn, after the lifting scissors have been moved to a lower position, absorb all of the load forces.

The complete segregation or separation of the supporting scissors and lifting scissors in accordance with the present invention is of a special advantage insofar as the vertical adjustment device for the lifting scissors may be manufactured as a separate group of components and may also be arranged subsequently in existing pedestal trestles equipped with supporting scissors.

Advantageously, in accordance with the present invention, the vertical adjustment device of the present invention may include two X-shaped lifting scissors arranged side by side, with lower or upper ends of the scissors being connected in pairs by cross axles which are movable with respect to one another by means of a suitable drive such as a screw spindle. By virtue of this arrangement, a vertical adjusting device is provided which enables a symmetrical support of the platform balanced with respect to force relationships, during the vertical adjustment. Moreover, a construction is provided which may be manufactured at a relatively low cost.

In accordance with further advantageous features of the present invention, the lifting scissors may rest, in a lowermost position, on compressed elevating springs which springs may, for example, bear 90% of the weight of the pedestal trestle part to be hoisted so as to considerably facilitate an initial extension of the lifting scissors from their lowest position.

According to the present invention, guide rails are provided for the runners or sliding elements of the lifting scissors, with the guide rails being suitably mounted to an underside of the platform and on a bottom side of the pedestal trestle frame. By virtue of the provision of these guide tracks or guide rails, it is possible to obtain a further improvement of the ready operability of the vertical adjustment device.

A pedestal trestle in accordance with the present invention may have a generally rectangular configuration and be of the size $1 \times 2$ m. The pedestal trestles may be set up in several side-by-side or one-behind-the other relationship and may readily be adjusted to the same height or two staggered levels. For example, in order to erect a staggered orchestra stage, it is desireable not to have to adjust all of the pedestal trestles individually in their levels but rather to construct the same so that they can simultaneously be adjusted in groups or rows. For this purpose, in accordance with the present invention, the pedestal trestle may be arranged in series in the longitudinal direction with identical pedestal trestles and the screw spindle may extend in each case over a length of the pedestal trestle and be connected by suitable coupling members with adjoining neighboring screw spindles in a non-rotatable fashion so as to enable the pedestal trestles to be simultaneously adjusted.

For safety reasons the pedestal trestles must be reliably mechanically locked in the respective vertically adjusted positions and, in accordance with the present invention, the pedestal trestles are provided with a central locking mechanism which makes it possible to effect a series-wise vertical adjustment of the pedestal trestles by, for example, only one person. For this purpose, the movable upper ends of the supporting scissors of the pedestal trestles carry spring-loaded detent pins which may be pulled out by adjusting means, against the spring force, from detent apertures in lateral spars of the top frame, with the detent pins being temporarily locked in position even in an unlocked condition of the pedestal trestle.

Advantageously, the detent pins are preferably connected by way of, for example, Bowden cables, to a central tie rod, with the tie rod being adjustable by associated adjusting mechanisms such as, for example, a manually actuated pawl lever or a motor driven adjustment means.

In accordance with still further features of the present invention, tie rods of series disposed pedestal trestles may be coupled together and the lateral spars of the top frames may be provided with slotted holes for receiving the detent pins. By virtue of these measures, it is possible during a vertical adjustment first to unlock the supporting scissors of, for example, five pedestal trestles arranged one behind the other and then to effect the vertical adjustment with the lifting scissors and subsequently relock the supporting scissors in the new adjustment level, with all of this being accomplished only by one person who is able to operate the locking mechanism and level adjustment device in succession.

Accordingly, it is an object of the present invention to provide a vertically adjustable pedestal trestle for theater stages or the like which avoids, by simple means, shortcomings and disadvantages encountered in the prior art.

Another object of the present invention resides in providing a vertically adjustable pedestal trestle for theater stages or the like which is simple in construction and therefore relatively inexpensive to manufacture.

Yet another object of the present invention resides in providing a vertically adjustable pedestal trestle for theater stages or the like which may be adjusted and locked by a single persons.

A further object of the present invention resides in providing a vertically adjustable pedestal trestle for theater stages of the like which, in a collapsed condition, is compact.

A still further object of the present invention resides in providing a vertically adjustable pedestal trestle for theater stages or the like which is lightweight in construction.

These and other objects, features, and advantages of the present invention will become more apparent from the following description when taken in connection with the accompanying drawings which show, for the purposes of illustration only, several embodiments in accordance with the present invention, and wherein:

FIG. 1 is a perspective view of a vertically adjustable pedestal trestle in an extended position constructed in accordance with the present invention;

FIG. *2a* is a plan view of the pedestal trestle of FIG. 1 in a folded down position;

FIG. *2b* is a plan view of pedestal trestle in a folded down condition constructed in accordance with another embodiment of the present invention;

Figure 1:
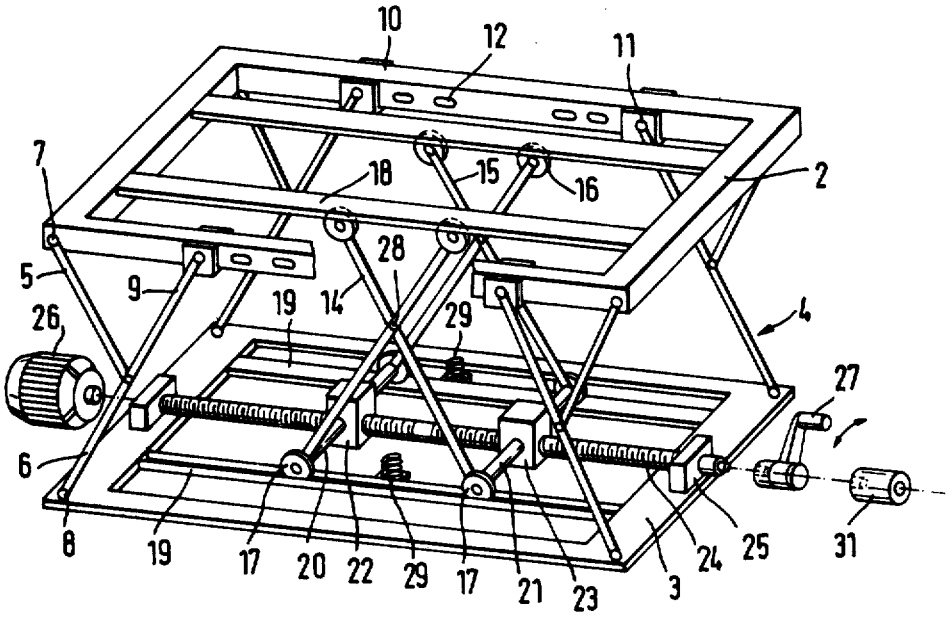

Referring now to the drawings wherein like reference numerals are used throughout the various views to designate like parts and, more particularly, to FIGS. 1 and *2a*, according to these figures, a pedestal trestle includes a top frame 2 carrying a platform 1, and a bottom frame 3 disposed on a floor or support side, with four Y-shaped supporting scissors generally designated by the reference numeral 4. The supporting scissors include scissor legs 5, 6, 9 with the scissor legs 5, 6 of each of the supporting scissors 4 being articulated to superimposed points 7, 8 at the top frame 2 and bottom frame 3. The upper movable leg 9 of each of the supporting scissors 4 is guided so as to be displaceable along lateral spars 10 of the top frame 2.

Spring-loaded detent pins 11 are provided in each of the movable legs 9, with the detent pins 11 being adapted to automatically engage into slotted holes 12 provided in the lateral spars 10 so as to securely lock the pedestal trestle in a selected vertical positional adjustment. The detent pins 11 may be pulled out of the retaining holes 12 in the lateral spars 10 by suitable means such as, for example, Bowden cables 13 so as to enable a preparation for a vertical adjustment. The operation of a pedestal trestle of the aforementioned type is described in greater detail in, for example, German Pat. No. 2,305,145.

As shown most clearly in FIG. 1, the pedestal trestle is equipped with separate vertical adjustment means which include two X-shaped scissors 14, 15 arranged side-by-side and centrally beneath the platform 1 of the pedestal trestle. The ends of the respective legs of the scissors 14, 15 are provided with upper runners 16 and lower runners 17. The upper runners 16 are associated with guide rails 18 at the top frame and/or at the platform 1, with the lower runners 19 being associated with guide rails 19 provided at the bottom frame 3. The lower runners 17 of the two scissors 14, 15 are respectively joined in pairs by one transverse axle 20, 21. The axles 20, 21 respectively carry a pressure member or thrust member 22, 23 provided with a threadable bore. The two pads or pressure members 22, 23 are provided with oppositely directed internal threads, are penetrated by a screw spindle 24, the respective longitudinal halves of which have opposite threads.

The screw spindle 24 is supported in bearing blocks 25 provided at the bottom frame 3 and may be driven or turned either by a drive motor 26 or a ratchet lever 27. By virtue of the provision of the screw spindle 24, the pedestal trestle, with the supporting scissors 4 being unlocked, may be adjusted between the positions illustrated in FIGS. 1 and 2*a* in an upward and downward direction. In order to facilitate an upward movement from the lowest position illustrated in FIG. 2*a*, the lifting scissors 14, 15 are biased or urged in an upward direction in a zone of a central joint 28 by elevating springs 29 which, in the closed position illustrated in FIG. 2*a*, are compressed, with a force of the elevating spring or springs 29 being such that it corresponds to 90% of the weight to be lifted by the lifting scissors 4.

Figure 2A:
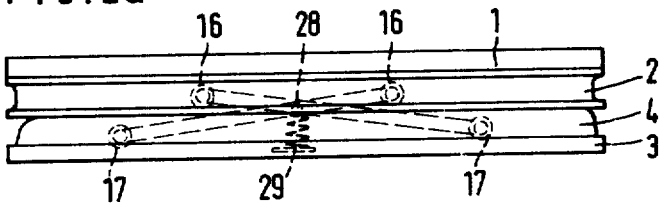
Figure 2B:
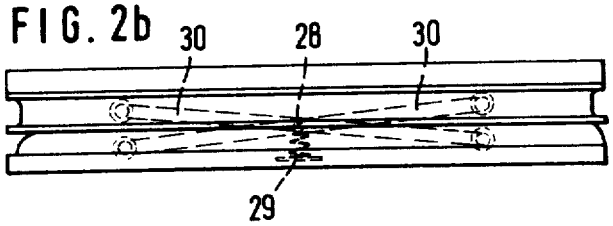

While the upper arms or legs of the lifting scissors 14, 15 are shorter than the lower arms in the construction of FIGS. 1 and 2*a*, it is also possible, as shown in FIG. 2*b*, to provide a construction wherein all the arms 30 of the lifting scissors are of equal length.

In order to enable a simultaneous vertical adjustment of several pedestal trestles arranged in series in the longitudinal direction, coupling members 31 are provided for the respective pedestal trestles so as to enable a coupling of screw spindles 24 of neighboring pedestal trestles so that the screw spindles may be joined and combined for a common rotation.

FIGS. 3–6 provide an example of a central locking-/unlocking mechanism which enables the effecting of an unlocking, i.e., a pulling back of the detent pins 11, in a convenient manner not only for a single pedestal trestle but also to effect a simultaneous unlocking of a plurality of pedestal trestles arranged one behind the other. More particularly, as shown in FIGS. 3–6, the central mechanism includes a tie rod 32 displaceably mounted beneath the platform 1. The tie rod 32 is adapted to be connected by way of a U-shaped coupling bracket generally designated by the reference numeral 33 with a tie rod 32' disposed beneath a platform 1' of a neighboring pedestal trestle. As can readily be appreciated, the number of U-shaped coupling brackets 33 is determined by the number of pedestal trestles which are to be connected together to enable a simultaneous unlocking action.

Figure 4:
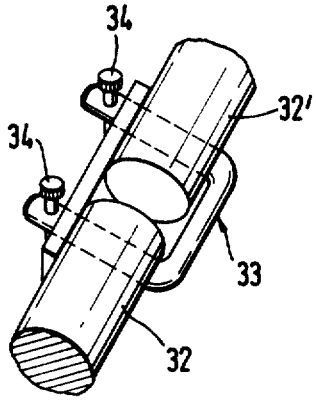
FIG. 4 is an enlarged view of a coupling detail designated IV in FIG. 3.

As shown most clearly in FIG. 4, the tie rods 32, 32' are each provided with transversely extending bore near their respective adjacent ends, which bore is adapted to accommodate the legs of the U-shaped coupling brackets 33. The legs of the U-shaped coupling bracket 33 are provided with transverse bores for accommodating securing elements such as securing pins 34.

Figure 3:
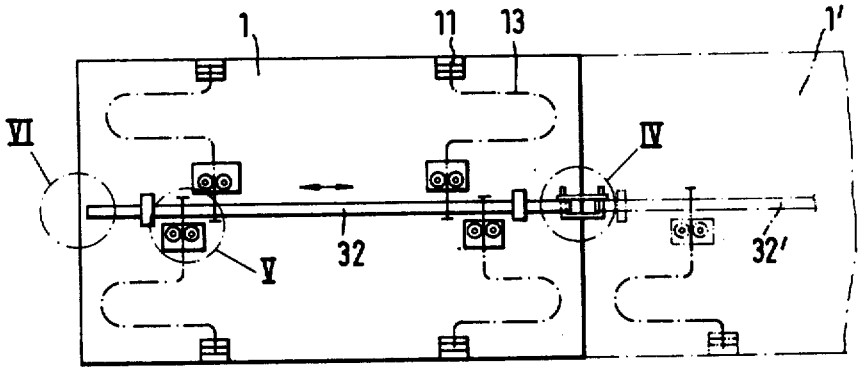
FIG. 3 is a bottom view of platforms of two series-arranged pedestal trestles with a central locking mechanism constructed in accordance with the present invention.
Figure 5:
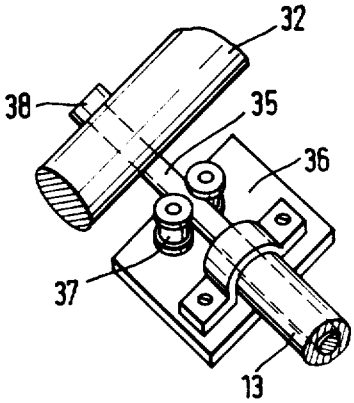
FIG. 5 is an enlarged detailed view of the area designated V in FIG. 3.

As shown most clearly in FIGS. 3 and 5, the Bowden cables 13 extend from the respective detent pins 11 with cores 35 of the Bowden cables 13 being attached to the tie rods 32, 32'. Outer jackets of the Bowden cables 13 are rigidly attached closely beside the respective tie rods 32, 32' to the platforms 1, 1' by small bearing blocks 36. Each core 35 extends between two guide rollers 37 rigidly mounted to the bearing block 36 and passes through a transverse bore provided in the tie rods 32, 32'. The respective cores 35 are attached to a rear side of the tie rods 32, 32' by means of a cross-head 38. Since the guide rollers 37 lie in a direct vicinity beside or adjacent the tie rod 32, a force for retracting the bearing pins 11 from the retaining holes 12 is at all times exerted independently of a displacement direction of the tie rods 32, with the force being exerted by the Bowden cable core 35.

Figure 6:
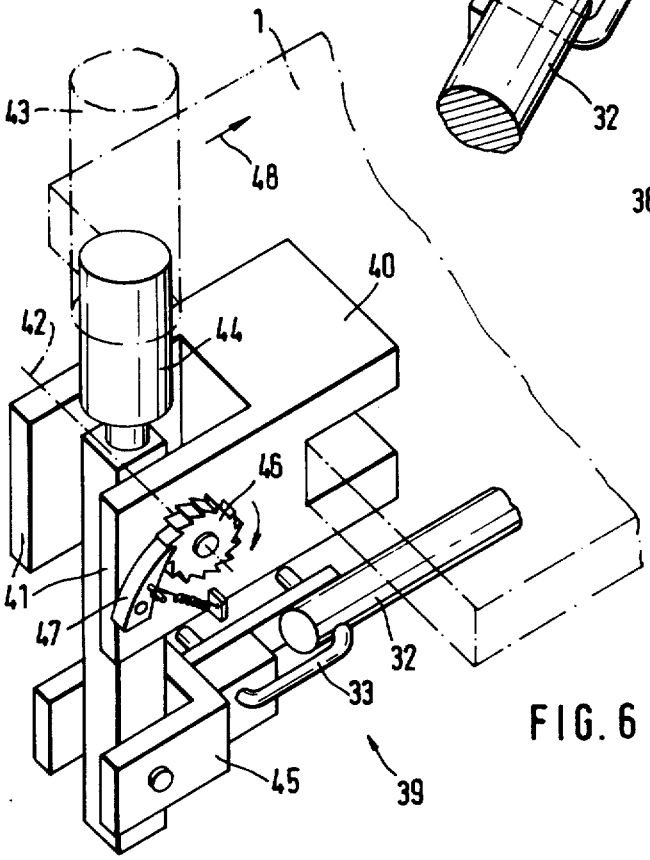
FIG. 6 is an enlarged perspective view of a click-and-pawl lever adapted to be attached to the central locking mechanism in the area designated VI in FIG. 3.

In order to enable an adjustment of the tie rods 32, 32', it is necessary to overcome the force of the spring loads of all the detent pins 11 and, for this purpose, a mechanism such as illustrated in FIG. 6 may be provided. As shown in FIG. 6, a click-and-pawl lever arrangement generally designated by the reference numeral 39 may be provided which includes a U-shaped base member 40 having a U-shaped opening extending over a rim or edge of the platform 1. An axle 42 is supported in vertically extending jaws 41 of the base member 40 at a position opposite to the U-shaped opening. A lever 44 which may be extended in length by a tubular section 43, is mounted so as to be pivotable about the axle 42. A lower extended end of the lever 44 is provided with an articulated fishplate 45 which may be coupled, through a bracket 33 (see also FIG. 4) to the end of the tie rod 32. A ratchet wheel 46 is mounted on the axle 42, with the ratchet wheel 46 being blocked against rotation in a counterclockwise direction by a pawl 47 which is urged into engagement with the ratchet wheel 46 by the force of a tension spring.

In order to effect a vertical adjustment of a row of coupled together pedestal trestles, the lifting scissors 14, 15 of all coupled pedestal trestles are first extended by, for example, activating the electric motor 26, until the lifting scissors 14, 15 have somewhat lifted the platforms so that the detent pins 11, relieved of their spring loading, lie in a central zone of the associated slotted holes 12. Thereafter, the mechanism 39 is attached to the tie rod 32 and, by urging the tubular section 43 inwardly in a direction of the arrow 48, (FIG. 6), all of the detent pins 11 are pulled back out of the detent holes 12. The pawl 47 retains the mechanism 39 in the position wherein the detent pins 11 are withdrawn and thus the tie rod 32 is in an unlocked position.

With the detent pins 11 being in a retracted position, the lifting scissors 14, 15 may be extended to a higher position by operation of the drive motor 26 so as to enable an extending of the pedestal trestle to a position somewhat higher than desired. Thereafter, the pawl 47 is removed from engagement with the wheel 36 and the tie rod 32 is released. The detent pins 11 are urged by their respective springs against the lateral spars 10 and-/or, in case of a favorable alignment, engage in the detent openings 12. Any detent pins 11 which may remain seated on the portion of the lateral spars 10 during the unlocking step will snap into the associated slot holes 12 automatically during a subsequent lowering of the lifting scissors 14, 15, whereupon the lifting scissors 14, 15 are again fully detached from the platform 1 so that any loads exerted on the platform 1 will subsequently be borne only by the supporting scissors 4.

As can readily be appreciated, other advantageous possibilities may be realized with the present invention. For example, in lieu of a central spindle 24, it is also possible to provide two parallel spindles for adjusting the lifting scissors 14, 15. Moreover, instead of executing an unlocking operation by means of a mechanical auxiliary mechanism such as shown in FIG. 6, it is also possible to provide an electrical or electromagnetic drive mechanism for effecting the unlocking of the detent pins 11. Due to the possibility of erroneous operation of the unlocking device which may occur with an electrical or electromagnetic drive mechanism due to the pressing of a button or actuating a switch, the use of an auxiliary device, which after effecting a vertical adjustment may be removed again is preferred since in this way unauthorized or unintended unlocking action is precluded.

While I have shown and described several embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. An adjustable pedestal trestle comprising a top frame means, a platform carried by said top frame means, and four supporting scissors means each having at least three legs, one leg of each of said four supporting scissors means is connected to a corner area of the top frame means for supporting the platform equally in a raised in-use position, characterized in that means are provided for vertically lifting the platform including at least one lifting scissors means arranged centrally below the platform within an area defined between the four supporting scissors means, said lifting scissors means being extensible in a direction toward and away from an underside of the platform, in that means are provided for locking the supporting scissors means in an adjusted raised in-use position so as to enable the lifting scissors means to be moved in a direction away from the underside of the platform in the raised in-use position, and in that means are provided for driving the lifting scissors means.

2. An adjustable pedestal trestle according to claim 1, characterized in that means are provided for articulatingly connecting the supporting scissors means to the top frame means.

3. An adjustable pedestal trestle according to claim 1, characterized in that the means for vertically lifting the platform includes at least two lifting scissors means arranged centrally below the platform in a side-by-side relationship, each of said lifting scissors means has a substantially X-shaped configuration, means are provided for connecting respective adjacent pairs of lower ends of the lifting scissors means to each other, and in that means are provided for moving the connecting means of the respective pairs of lower ends of the lifting scissors means with respect to each other so as to enable a raising and lowering of the lifting scissors means.

4. An adjustable pedestal trestle according to claim 3, characterized in that the connecting means includes a pair of transversely extending axles respectively disposed between adjacent lower ends of the lifting scissors means, and in that the moving means includes a threaded spindle means connected to the axles.

5. An adjustable pedestal trestle according to claim 4, characterized in that means are provided for urging the lifting scissors means in a direction of the platform when the lifting scissors means are in a lowered position.

6. An adjustable pedestal trestle according to claim 5, characterized in that the urging means includes at least one compressed spring means acting on the lifting scissors means.

7. An adjustable pedestal trestle according to one of claims 3 or 4, characterized in that guiding means are provided for guiding a movement of the lifting scissors means including runners provided at the respective ends of the lifting scissors means, first guide rails are arranged on an underside of the platform for cooperation with the runners provided at the upper end of the lifting scissors means, and second guide rails are provided on a bottom frame and are cooperable with runners provided at the lower end of the lifting scissors means.

8. An adjustable pedestal trestle according to claim 4, characterized in that a plurality of pedestal trestles are provided and are arranged adjacent one another in a row extending in a longitudinal direction, and in that means are provided for coupling the threaded spindle means of neighboring pedestal trestles to each other so as to enable a simultaneous raising and lower of the lifting scissors means of each of the trestles.

9. An adjustable pedestal trestle according to claim 8, characterized in that means are provided for locking the supporting scissors means in an adjusted raised position including spring loaded detent means arranged at the upper end of each of the supporting scissors means, means are provided in the top frame for accommodating the detent means, and in that means are provided for temporarily locking the detent means in an unlocked condition of the respective pedestal trestles.

10. An adjustable pedestal trestle according to claim 9, characterized in that the means for temporarily locking the spring loaded detent means includes a central tie rod displaceably mounted beneath the platform of each of the pedestal trestles, cable means are provided for connecting the locking detect means associated with the respective pedestal trestles to the central tie rod of the pedestal trestle, and in that means are provided for adjusting the respective control tie rods so as to hold the spring loaded detent means against the spring bias thereof.

11. An adjustable pedestal trestle according to claim 10, characterized in that the cable means is a Bowden cable, and in that the adjusting means is a pawl and ratchet mechanism.

12. An adjustable pedestal trestle according to claim 11, characterized in that means are provided for coupling the central tie rods of neighboring pedestal trestles to each other so as to enable a simultaneous adjustment of all of the central tie rods by the adjusting means.

13. An adjustable pedestal trestle according to claim 9, characterized in that the spring loaded detent means includes detent pins, and in that the means for accommodating the spring loaded detent means includes a plurality of slotted holes provided in lateral walls of the top frame means.

14. An adjustable pedestal trestle comprising a top frame means, a platform carried by said top frame means, and a supporting scissors means connected to the top frame means for supporting the platform in a raised position, wherein means are provided for vertically adjusting the platform including at least one lifting scissors means arranged centrally below the platform and being extensible in a direction toward an underside of the platform, means are provided at respective ends of the lifting scissors means for guiding a movement of the scissors means, means are provided for locking the supporting scissors means in an adjusted raised position including spring loaded detent means arranged at an upper end of the supporting scissors means, means are provided in the top frame means for accommodating the detent means, and in that means are provided for temporarily retaining and locking the detent means in an unlocked condition of the supporting scissors means.

15. An adjustable pedestal trestle according to claim 14, characterized in that the means for retaining and locking the detent means includes a central tie rod displaceably mounted beneath the platform, cable means for connecting the locking detent means to the central tie rod, and in that means are provided for adjusting the central tie rod so as to hold the spring loaded detent means against the spring bias thereof.

16. An adjustable pedestal trestle according to claim 15, characterized in that the cable means is a Bowden cable and in that the adjusting means is a pawl and ratchet mechanism.

17. An adjustable pedestal trestle according to claim 14, characterized in that the spring loaded detent means includes detent pins, and in that the means for accommodating the spring loaded detent means includes a plurality of slotted holes provided in lateral walls of the top frame means.

18. An adjustable pedestal trestle according to claim 14, wherein the means for temporarily retaining and locking the detent means includes electromagnetic means.

* * * * *